US009693619B2

(12) United States Patent
Ki

(10) Patent No.: US 9,693,619 B2
(45) Date of Patent: Jul. 4, 2017

(54) COSMETIC CONTAINER

(71) Applicant: MINJIN Co., Ltd., Hwaseong (KR)

(72) Inventor: Keun Seo Ki, Suwon (KR)

(73) Assignee: MINJIN CO., LTD., Hwaseong-si (KR)

( * ) Notice: Subject to any disclaimer, the term of this patent is extended or adjusted under 35 U.S.C. 154(b) by 0 days.

(21) Appl. No.: 14/909,777

(22) PCT Filed: Oct. 7, 2014

(86) PCT No.: PCT/KR2014/009451
§ 371 (c)(1),
(2) Date: Feb. 3, 2016

(87) PCT Pub. No.: WO2015/182830
PCT Pub. Date: Dec. 3, 2015

(65) Prior Publication Data

US 2017/0065058 A1 Mar. 9, 2017

(30) Foreign Application Priority Data

May 26, 2014 (KR) ..... 10-2014-0062943

(51) Int. Cl.
*B67D 7/70* (2010.01)
*A45D 40/24* (2006.01)
(Continued)

(52) U.S. Cl.
CPC ..... *A45D 40/24* (2013.01); *A45D 34/00* (2013.01); *A45D 34/04* (2013.01);
(Continued)

(58) Field of Classification Search
CPC .... A45D 40/24; A45D 40/0075; A45D 34/04; A45D 34/00; B65D 81/32; B65D 81/3288; B65D 47/06
(Continued)

(56) References Cited

U.S. PATENT DOCUMENTS 5,740,947 A * 4/1998 Flaig ..... B65D 81/3288 220/23.4
7,137,531 B2 * 11/2006 Arghyris ..... B05B 11/0043 222/105
(Continued)

FOREIGN PATENT DOCUMENTS

JP 2011-207515 10/2011
KR 20-0317079 6/2003
(Continued)

OTHER PUBLICATIONS

International Search Report, Patent Cooperation Treaty, Application No. PCT/KR2014/009451, Nov. 19, 2014.

*Primary Examiner* — Lien Ngo
(74) *Attorney, Agent, or Firm* — Lex IP Meister, PLLC

(57) ABSTRACT

The present invention may provide a cosmetic container including: a container part (100) that includes a first container (110) including a first composition and a second container (120) including a second composition and is formed by combining the first container (110) and the second container (120); a first airless pump module (200) that includes a first intake tube (210) and a first pipe (220) communicating with the first intake tube (210) and is mounted on the first container (100); a second airless pump module (300) that includes a second intake tube (310) and a second pipe (320) communicating with the second intake tube (310) and is mounted on the second container (120); and a pressing unit (400) that includes a first pressing cap (410) having a first intake hole (411) connected with the first pipe (220) and a first dispense hole (412) for dispensing the first composition in the first intake hole (411), and a second pressing cap (420) having a second intake hole (421) connected with the second pipe (320) and a second dispense hole (422) for dispensing the second composition in the second intake hole (421), wherein the first pressing cap
(Continued)

(410) and the second pressing cap (420) are combined and disposed on the top of the container (100) to be vertically movable, a rail (414) is vertically and convexly formed on a coupling side of the first pressing cap (410), and a rail groove (424) where the rail (414) is inserted is vertically and concavely formed on a coupling side of the second pressing cap (420), so the first pressing cap (410) and the second pressing cap (420) independently move.

4 Claims, 8 Drawing Sheets

(51) Int. Cl.

| | |
|---|---|
| ***A45D 34/04*** | (2006.01) |
| ***B65D 81/32*** | (2006.01) |
| ***A45D 34/00*** | (2006.01) |
| ***A45D 40/00*** | (2006.01) |
| ***B65D 47/06*** | (2006.01) |

(52) U.S. Cl.
CPC ..... *A45D 40/0075* (2013.01); *B65D 47/06* (2013.01); *B65D 81/32* (2013.01); *B65D 81/3288* (2013.01)

(58) Field of Classification Search
USPC ..... 222/135–137, 132, 321.7, 321.9
See application file for complete search history.

(56) References Cited

U.S. PATENT DOCUMENTS

| | | | | |
|---|---|---|---|---|
| 7,651,035 | B2 * | 1/2010 | van der Heijden ... | B01F 5/0641 222/135 |
| 7,793,799 | B2 * | 9/2010 | Reggiani ..... | A45D 40/24 220/526 |
| 8,225,962 | B2 * | 7/2012 | Rossignol ..... | B05B 11/0078 222/135 |
| 8,413,849 | B2 * | 4/2013 | Flores ..... | A47K 5/1202 222/135 |
| 2005/0150905 | A1 * | 7/2005 | van der Heijden . | B05B 11/3084 222/135 |

FOREIGN PATENT DOCUMENTS

| | | |
|---|---|---|
| KR | 20-0446883 | 11/2009 |
| KR | 20-0453458 | 4/2011 |
| KR | 2020140003301 | 6/2014 |

* cited by examiner

COSMETIC CONTAINER

TECHNICAL FIELD

The present invention relates to a cosmetic container, and more particularly, a dual type cosmetic container that can keep and dispense two kinds of compositions.

BACKGROUND ART

Most containers for keeping a make-up use an airless pump type. Those cosmetic containers are convenient to dispense a predetermined amount of liquid-state or emulsion type make-up, and particularly, dispense a small amount of make-up kept therein, so the make-up is prevented from coming in contact with air and the entire make-up is prevented from being contaminated.

On the other hand, dual type cosmetics providing two effects with one product have been on the market. Those cosmetics separately keep two kinds of compositions in one container and mix them in use. Those cosmetics can emphasize the inherent features of the composition to customers, in addition to increasing the function of the compositions, so they contribute to increasing the commercial value of products.

There is a need for a cosmetic container that has a structure separately keeping compositions and can dispense them in order to keep and dispense the dual type cosmetics.

A cosmetic container having two airless pumps has been disclosed in Korean Utility Model Application Publication No. 2013-0003847 (published on 28 Jun. 2013, hereafter, called this document). The cosmetic container proposed in this document has a receiving unit that can separately keep different make-ups in a container body and includes two airless pumps disposed in parallel over the receiving unit.

A push button is provided on the two airless pumps, and two discharge pipe and two dispense holes are formed in the push button, so when the push button is pressed, compositions are discharged from the two airless pumps to the outside through the discharge pipes and the dispense holes.

With respect to the two airless pumps, the lengths from the discharge pipes to the dispense holes, the lengths of the discharge pipes, and the positions of the dispense holes are the same, so when the push button is pressed once, the same amounts of compositions are discharged from the two dispense holes, respectively.

However, the compositions may be different in viscosity, so they may be discharged in different amounts of the compositions when a user presses the push button once. In particular, when the viscosity difference is large, the discharged amounts may be largely different. When the difference of discharged amount of the compositions is large, any one of the compositions is left and thrown away.

In general, considering that two compositions having different functions are combined in a product and they may be largely different in viscosity, this problem greatly reduces the commercial value of the product.

Further, such a cosmetic container simultaneously disposes two kinds of compositions when a user presses a push button once, so it cannot dispense only any one of the two kinds of compositions.

DISCLOSURE

Technical Problem

Accordingly, in order to solve the problems, an object of the present invention is to provide a cosmetic container that can keep and dispose two kinds of compositions separately.

In particular, an object of the present invention is to provide a cosmetic container that can separately keep and dispense two kinds of compositions while having the shape of a common cosmetic container keeping and discharging one composition.

Objects of the present invention are not limited thereto and other objects not stated herein may be clearly understood by those skilled in the art.

Technical Solution

In order to achieve the objects, the present invention may provide a cosmetic container including: a container part 100 that includes a first container 110 including a first composition and a second container 120 including a second composition and is formed by combining the first container 110 and the second container 120; a first airless pump module 200 that includes a first intake tube 210 and a first pipe 220 communicating with the first intake tube 210 and is mounted on the first container 100; a second airless pump module 300 that includes a second intake tube 310 and a second pipe 320 communicating with the second intake tube 310 and is mounted on the second container 120; and a pressing unit 400 that includes a first pressing cap 410 having a first intake hole 411 connected with the first pipe 220 and a first dispense hole 412 for dispensing the first composition in the first intake hole 411, and a second pressing cap 420 having a second intake hole 421 connected with the second pipe 320 and a second dispense hole 422 for dispensing the second composition in the second intake hole 421, in which the first pressing cap 410 and the second pressing cap 420 are combined and disposed on the top of the container 100 to be vertically movable, a rail 414 is vertically and convexly formed on a coupling side of the first pressing cap 410, and a rail groove 424 where the rail 414 is inserted is vertically and concavely formed on a coupling side of the second pressing cap 420, so the first pressing cap 410 and the second pressing cap 420 independently move.

Preferably, the coupling sides of the first pressing cap 410 and the second pressing cap 420 may be vertically formed.

Preferably, a projection may be formed at ends of the rail 414 to lock the rail 414 to the rail groove 424 so that the first pressing cap 410 and the second pressing cap 420 are horizontally locked to each other.

Preferably, the first pressing cap 410 and the second pressing cap may be formed in a half cylindrical shape.

Advantageous Effects

According to the cosmetic container of an embodiment of the present invention, two pressing caps connected with two airless pump modules, respectively, and independently moving are provided, so it is possible to dispense different kinds of compositions simultaneously or independently.

BEST MODE

Figure 1:
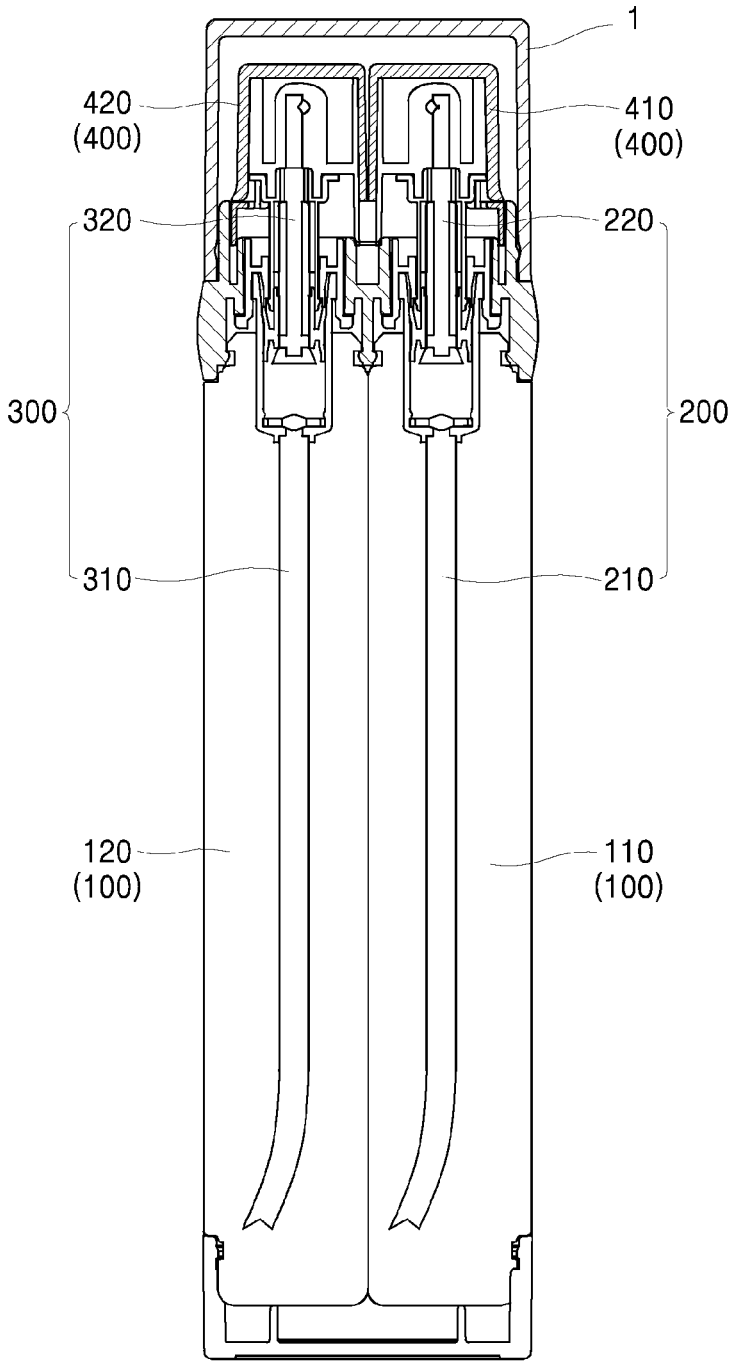
FIG. 1 is a cross-sectional view of a cosmetic container according to an embodiment of the present invention.

Hereinafter, embodiments of the present invention will be described in detail with reference to the accompanying drawings. First, in the specification, in giving reference numerals to components throughout the drawings, it should be noted that like reference numerals designate like components even though the components are shown in different drawings. Further, although exemplary embodiments of the present invention will be described hereafter, the spirit of the present invention is not limited thereto and may be modified and implemented in various ways by those skilled in the art.

Terms including ordinal numbers such as first and second can be used for describing various components, but the components are not limited by the terms. The terms are used only for discriminating one component from another component. For example, a second component may be referred to as a first component, and the first components may also be referred to as the second component without departing from the scope of the present invention. A term 'and/of' includes combinations of a plurality of relevant items or any one a plurality of relevant items.

Terms used in the present specification are used only in order to describe specific exemplary embodiments rather than limiting the present invention. Singular forms are intended to include plural forms unless the context clearly indicates otherwise. It will be further understood that the terms "comprises" or "have" used in this specification, specify the presence of stated features, steps, operations, components, parts, or a combination thereof, but do not preclude the presence or addition of one or more other features, numerals, steps, operations, components, parts, or a combination thereof.

FIG. 1 is a cross-sectional view showing a cosmetic container according to an embodiment of the present invention. FIG. 1 clearly shows main parts for conceptual clear understanding, so they may be modified in various ways and the scope of the present invention is not limited to specific shapes in the drawings.

Referring to FIG. 1, a cosmetic container according to an embodiment of the present invention may include a container part 100, a first airless pump module 200, a second airless pump module 300, and a pushing unit 400.

First, the container part 100 may be formed such that a first container 110 and a second container 120 form a container body by being combined with each other. The first container 110 and the second container 120 has an internal space for keeping a different composition therein, and the internal spaces may have the same volume, but the present invention is not limited thereto.

The first container 100 and the second container 200 may be combined to make a cylindrical container body to form a container body, and concave areas and convex areas of the contact sides of the first container 100 and the second container 200 may be in contact with each other to be more strongly combined.

The top of the container part 100 may be covered with a cap 1.

The first airless pump module 200 may be mounted on the first container 110. The second airless pump module 400 may be mounted on the second container 120.

The first airless pump module 200 has a first intake tube 210 at the lower portion and a first pipe 220 connected with the first intake tube 210. The first intake tube 210 communicates with the internal space of the first container 100 to take a composition inside. The first pipe 220 guides the composition taken in side through the first intake tube 310 to the pressing unit 400.

The second airless pump module 300 has a second intake tube 310 at the lower portion and a second pipe 320 connected with the second intake tube 310. The second intake tube 310 communicates with the internal space of the second container 200 to take a composition inside. The second pipe 320 guides the second composition taken inside through the second intake tube 310 to the pressing unit 400.

Figure 2:
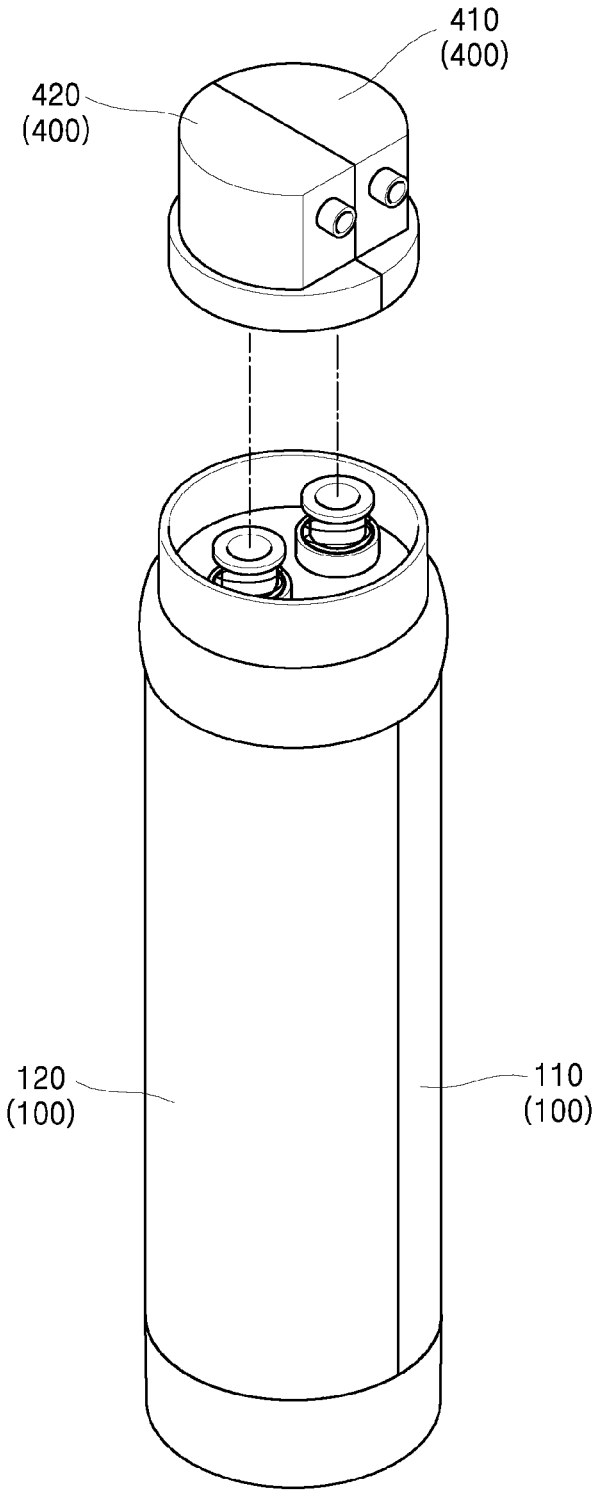
FIG. 2 is a view showing a pressing unit coupled to a container part.
Figure 3:
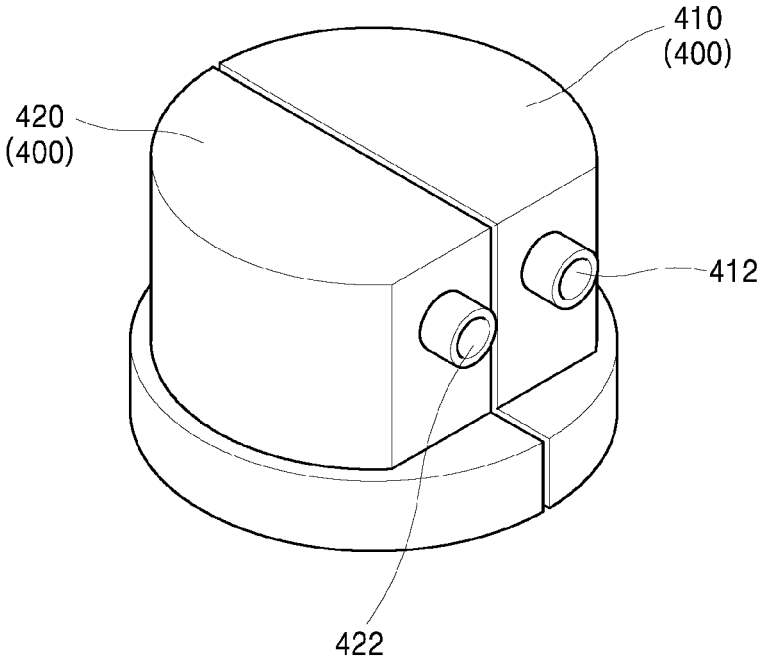
FIG. 3 is a view showing the pressing unit composed of a first pressing cap and a second pressing cap.
Figure 4:
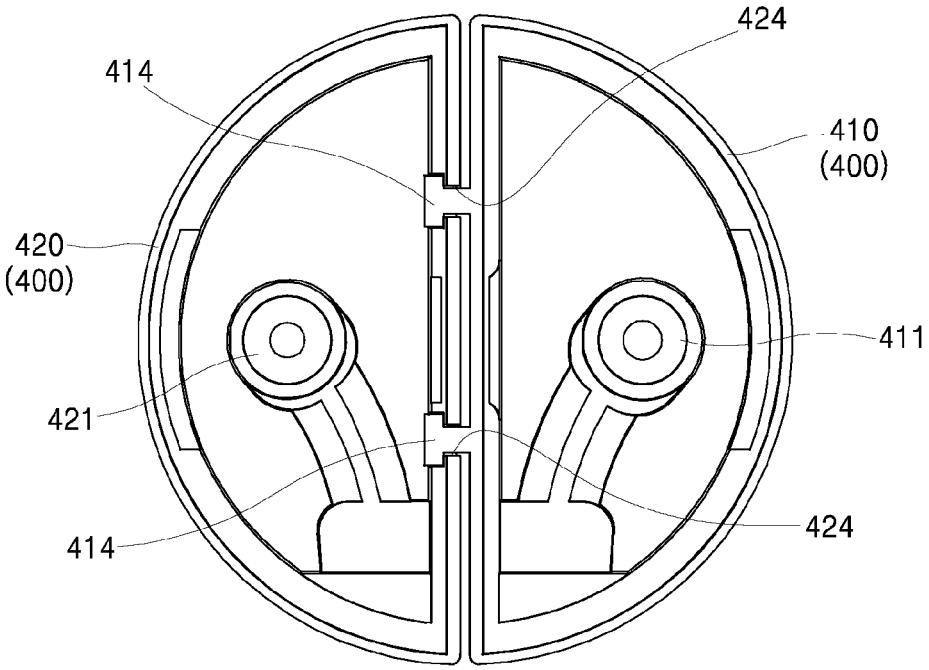
FIG. 4 is a view showing the bottom of the pressing unit shown in FIG. 3.
Figure 5:
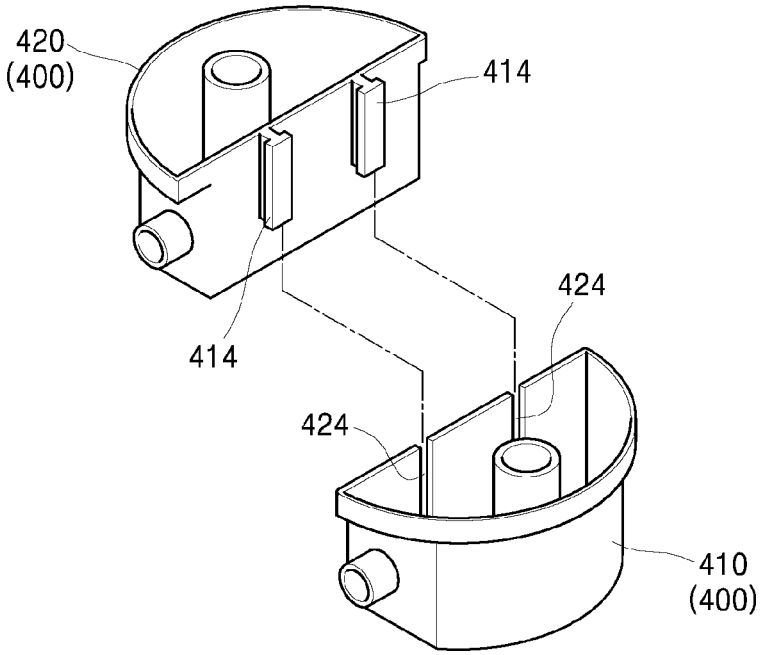
FIG. 5 is a view showing rails and rail grooves on the first pressing cap and the second pressing cap.

FIG. 2 is a view showing a pressing unit coupled to a container part, FIG. 3 is a view showing the pressing unit composed of a first pressing cap and a second pressing cap, FIG. 4 is a view showing the bottom of the pressing unit shown in FIG. 3, and FIG. 5 is a view showing rails and rail grooves on the first pressing cap and the second pressing cap.

Referring to FIGS. 2 to 5, the pressing unit 400 is disposed at the top of the container part 100 to be vertically movable, so when it is pressed and moved up/down, it transmits a pumping force to the first airless pump module 200 and the second airless pump module 300. The pressing unit 400 may be formed by combining the first pressing cap 410 and the second pressing cap 420.

First, the first pressing cap 410 may have a first intake hole 411 formed toward the bottom therein. The first intake hole 411 may communicate with the first pipe 220 of the first airless pump module 200 to take a composition inside. A first dispense hole 412 may be formed at the front of the first pressing cap 410. The first dispense hole 412 communicates with the first intake hole 411 to dispense the composition taken inside through the first intake hole 411.

The first intake hole 411 and the first dispense hole 412 may be formed perpendicular to each other.

Next, the second pressing cap 420 may have a second intake hole 421 formed toward the bottom therein. The second intake hole 421 may communicate with the second pipe 320 of the second airless pump module 300 to take a composition inside. A second dispense hole 422 may be formed at the front of the second pressing cap 420. The second dispense hole 422 communicates with the second intake hole 421 to dispense the composition taken inside through the second intake hole 421.

The first pressing cap 410 and the second pressing cap 420 may be formed in a half cylindrical shape and form one cylindrical pressing unit 400 by being combined. In an embodiment, the coupling sides of the first pressing cap 410 and the second pressing cap 420 may be vertically formed and the first pressing cap 410 and the second pressing cap 420 may vertically move with respect to each other long the coupling sides.

In detail, a rail 414 may be vertically and convexly formed on the coupling side of the first pressing cap 410. Further, a rail groove 424 where the rail 414 is inserted to slide may be vertically and concavely formed on the coupling side of the second pressing cap 420. A projection may be formed at the ends of the rail 414 to prevent the rail 414 from separating from the rail groove 424.

The first pressing cap 410 and the second pressing cap 420 can independently move without influencing the movement of each other, when an external force is applied. Accordingly, the first airless pump module 200 and the second airless pump module 300 can be independently operated, when a user presses the pressing caps.

Figure 6:
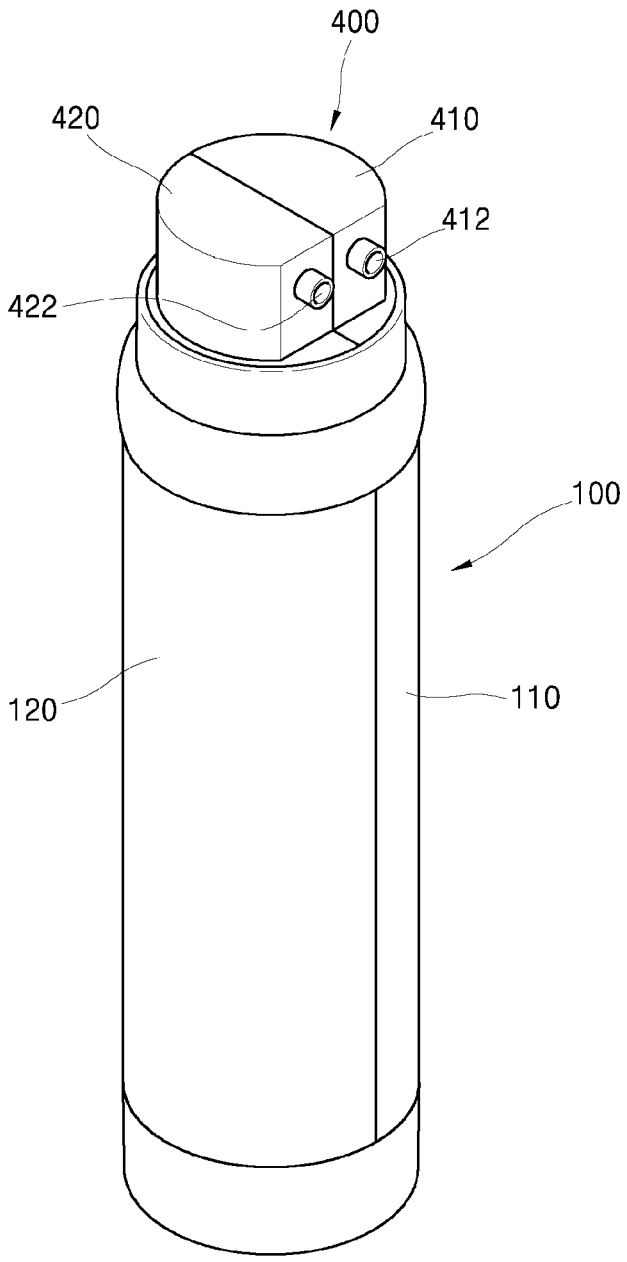
FIG. 6 is a perspective view showing the cosmetic container shown in FIG. 1.

FIG. 6 is a perspective view showing the cosmetic container shown in FIG. 1.

AS show in FIG. 6, the first pressing cap 410 and the second pressing cap 420 are mounted on the container part 100 in contact with each other, so the single pressing unit 400 can be achieved.

Figure 7:
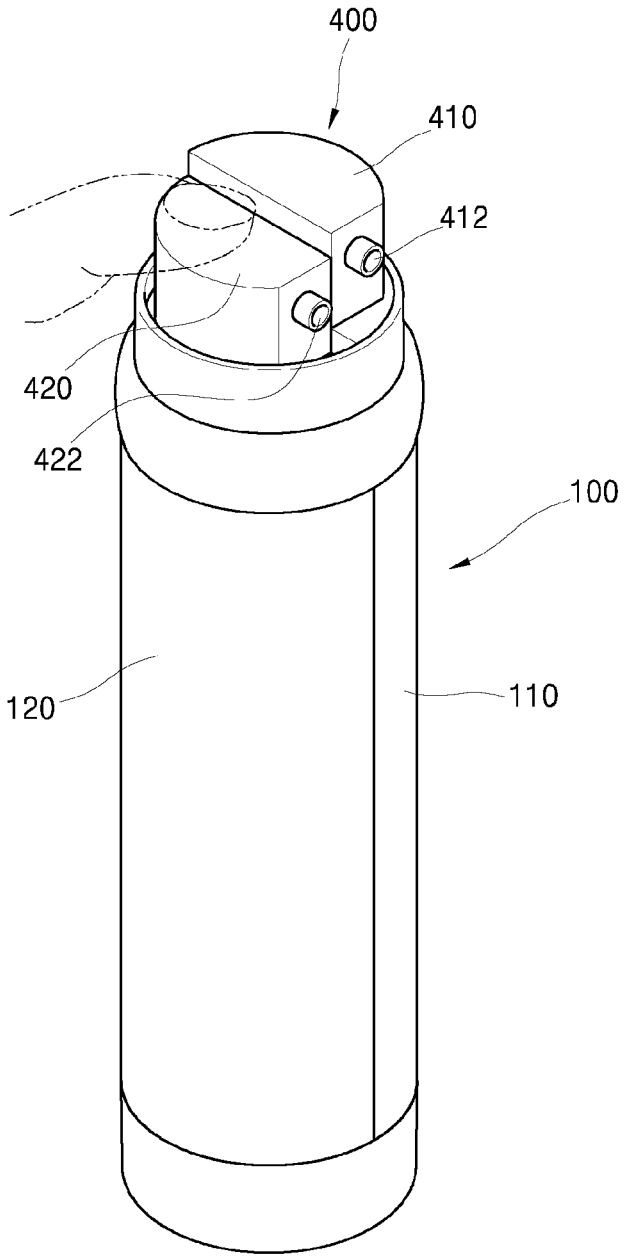
FIG. 7 is a view showing the cosmetic container with only the first pressing cap pressed.
Figure 8:
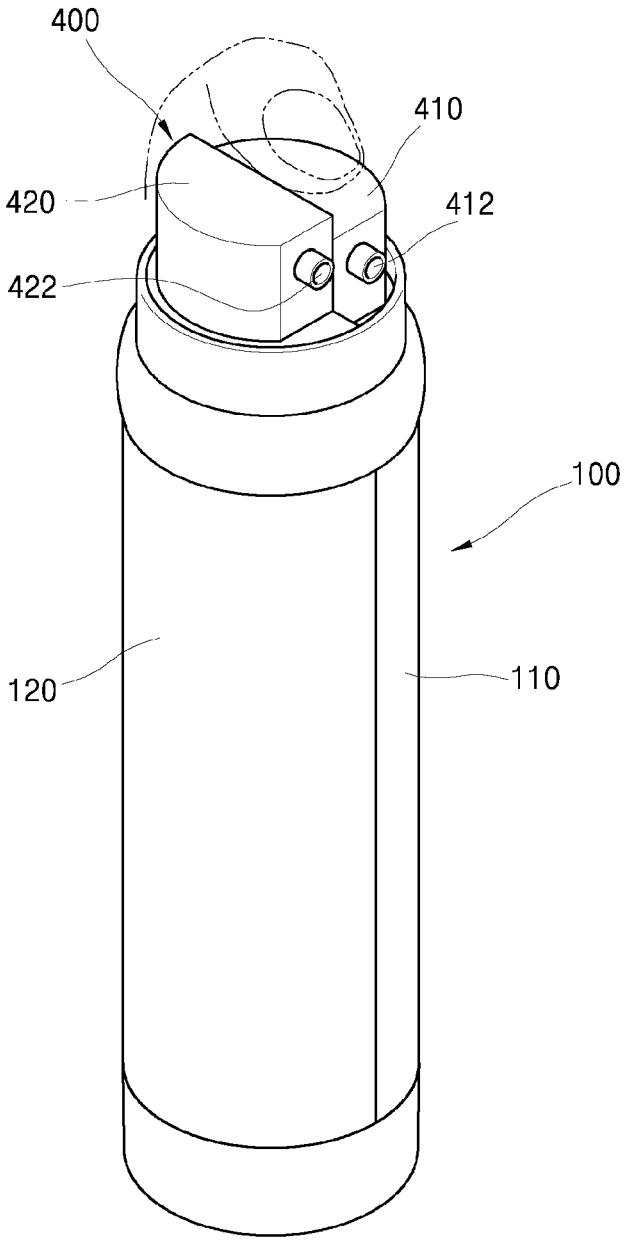
FIG. 8 is a view showing the cosmetic container with only the second pressing cap pressed.
Figure 9:
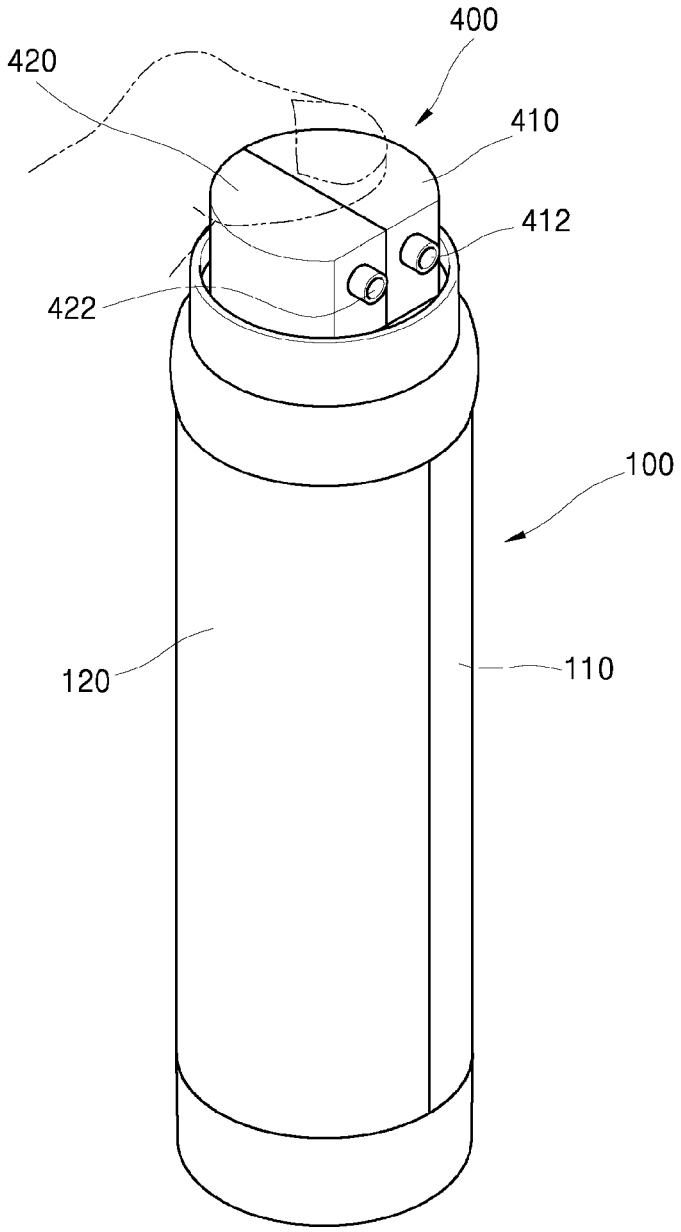
FIG. 9 is a view showing the cosmetic container with both of the first pressing cap and the second pressing cap pressed.

FIG. 7 is a view showing the cosmetic container with only the first pressing cap pressed. FIG. 8 is a view showing the cosmetic container with only the second pressing cap pressed. FIG. 9 is a view showing the cosmetic container with both of the first pressing cap and the second pressing cap pressed.

As shown in FIG. 7, a user can dispense only the composition in the second container 120 through the second dispense hole 422 by pressing only the second pressing cap 420.

Further, as shown in FIG. 8, a user can dispense only the composition in the first container 110 through the first dispense hole 412 by pressing only the first pressing cap 410.

Further, as shown in FIG. 9, a user can simultaneously dispense the compositions in the first container 110 and the second container 120 by simultaneously pressing the first pressing cap 410 and the second pressing cap 420.

A cosmetic container according to an embodiment of the present invent was described in detail with reference to the drawings.

The above description is an example that explains the spirit of the present invention and may be changed, modified, and replaced in various ways without departing from the basic features of the present invention by those skilled in the art. Accordingly, the embodiment described herein and the accompanying drawings re provided not to limit, but to explain the spirit of the present invention and the spirit and the scope of the present invention are not limited by the embodiments and the accompanying drawings. The protective range of the present disclosure should be construed on the basis of claims and all the technical spirits in the equivalent range should be construed as being included in the scope of the right of the present disclosure.

The invention claimed is:

1. A cosmetic container comprising:

a container part (100) that includes a first container (110) including a first composition and a second container (120) including a second composition and is formed by combining the first container (110) and the second container (120);

a first airless pump module (200) that includes a first intake tube (210) and a first pipe (220) communicating with the first intake tube (210) and is mounted on the first container (100);

a second airless pump module (300) that includes a second intake tube (310) and a second pipe (320) communicating with the second intake tube (310) and is mounted on the second container (120); and a pressing unit (400) that includes a first pressing cap (410) having a first intake hole (411) connected with the first pipe (220) and a first dispense hole (412) for dispensing the first composition in the first intake hole (411), and a second pressing cap (420) having a second intake hole (421) connected with the second pipe (320) and a second dispense hole (422) for dispensing the second composition in the second intake hole (421), wherein the first pressing cap (410) and the second pressing cap (420) are combined and disposed on the top of the container (100) to be vertically movable, a rail (414) is vertically and convexly formed on a coupling side of the first pressing cap (410), and a rail groove (424) where the rail (414) is inserted is vertically and concavely formed on a coupling side of the second pressing cap (420), so the first pressing cap (410) and the second pressing cap (420) each independently move.

2. The cosmetic container of claim 1, wherein the coupling sides of the first pressing cap (410) and the second pressing cap (420) are vertically formed.

3. The cosmetic container of claim 2, wherein a projection is formed at ends of the rail (414) to lock the rail (414) to the rail groove (424) so that the first pressing cap (410) and the second pressing cap (420) are horizontally locked to each other.

4. The cosmetic container of claim 1, wherein the first pressing cap (410) and the second pressing cap (420) are formed in a half cylindrical shape.

* * * * *